US008556602B2

(12) United States Patent
Mancini et al.

(10) Patent No.: US 8,556,602 B2
(45) Date of Patent: Oct. 15, 2013

(54) FUEL PUMP WITH REDUCED SEAL WEAR FOR A DIRECT INJECTION SYSTEM

(75) Inventors: Luca Mancini, Budrio (IT); Daniele De Vita, Castel San Pietro (IT); Massimo Mattioli, Calderara di Reno (IT)

(73) Assignee: Magneti Marelli S.p.A., Corbetta (IT)

( * ) Notice: Subject to any disclaimer, the term of this patent is extended or adjusted under 35 U.S.C. 154(b) by 323 days.

(21) Appl. No.: 12/938,819

(22) Filed: Nov. 3, 2010

(65) Prior Publication Data

US 2011/0108007 A1 May 12, 2011

(30) Foreign Application Priority Data

Nov. 3, 2009 (IT) ..... BO2009A0721

(51) Int. Cl.
*F04B 19/00* (2006.01)
*F01B 31/00* (2006.01)
*F16J 15/32* (2006.01)

(52) U.S. Cl.
USPC ..... 417/470; 92/86; 92/168; 277/566; 277/567

(58) Field of Classification Search
USPC ..... 417/470; 92/86, 128, 168; 277/559, 277/562, 564, 566, 567, 563
See application file for complete search history.

(56) References Cited

U.S. PATENT DOCUMENTS

| | | | | |
|---|---|---|---|---|
| 2,088,703 | A * | 8/1937 | Hubbard et al. | 277/555 |
| 3,489,098 | A * | 1/1970 | Roth et al. | 92/153 |
| 3,870,381 | A * | 3/1975 | Overkott | 384/16 |
| 4,807,890 | A * | 2/1989 | Gorman et al. | 277/346 |
| 7,757,663 | B2 * | 7/2010 | Usui et al. | 123/467 |
| 7,959,159 | B2 * | 6/2011 | Hocker et al. | 277/559 |
| 2006/0104843 | A1 | 5/2006 | Inoue | |
| 2008/0122184 | A1 | 5/2008 | Hocker et al. | |
| 2009/0008883 | A1 | 1/2009 | Nakayama et al. | |
| 2009/0068041 | A1 | 3/2009 | Beardmore | |

FOREIGN PATENT DOCUMENTS

| | | | |
|---|---|---|---|
| DE | 102008045730 | A1 | 3/2009 |
| EP | 1657438 | A1 | 5/2006 |
| EP | 1975402 | A1 | 10/2008 |
| WO | WO 2006/069818 | A1 * | 7/2006 |
| WO | WO-2008/061581 | A1 | 5/2008 |

* cited by examiner

*Primary Examiner* — Charles Freay

(74) *Attorney, Agent, or Firm* — Howard & Howard Attorneys PLLC

(57) ABSTRACT

A fuel pump for a direct injection system comprises at least one pumping chamber, a piston slidingly mounted inside the pumping chamber to cyclically vary volume thereof, an intake duct connected to the pumping chamber and regulated by an inlet valve, a delivery duct connected to the pumping chamber and regulated by a one-way valve that allows only outgoing-fuel flow from the pumping chamber, a seat arranged below the pumping chamber around a lower portion of the piston, an annular seal housed in the seat and preventing fuel leakage along a side wall of the piston, and an annular element that delimits, on an upper side thereof, the seat housing the seal such that an axial dimension of the seat is not greater than an axial dimension of the seal to prevent the seal from axially "shaking" inside the seat as a consequence of cyclic axial movement of the piston.

19 Claims, 8 Drawing Sheets

FUEL PUMP WITH REDUCED SEAL WEAR FOR A DIRECT INJECTION SYSTEM

CROSS-REFERENCE TO RELATED APPLICATION

This application claims priority under 35 U.S.C. §119 to Italian Patent Application No. BO2009A-000721, filed on Nov. 3, 2009 with the Italian Patent and Trademark Office, the disclosure of which is incorporated herein in its entirety by reference.

TECHNICAL FIELD

The present invention relates to a fuel pump for a direct injection system.

PRIOR ART

A direct injection system comprises a plurality of injectors, a common rail that feeds fuel under pressure to the injectors and a high pressure pump that feeds fuel to the common rail via a feed line, and is equipped with a flow regulating device and a control unit that pilots the flow regulating device to keep the fuel pressure inside the common rail equal to a desired value that generally varies with time as a function of the engine's operating conditions.

The high pressure pump comprises at least one pumping chamber inside which a piston slides with an alternating motion, an intake duct controlled by an inlet valve to feed low-pressure fuel inside the pumping chamber and a delivery line controlled by a delivery valve for supplying high-pressure fuel from the pumping chamber and to the common rail through the feed line. As a rule, the flow regulating device acts on the inlet valve, keeping the inlet valve open even during the pumping stage, so that a variable part of the fuel present in the pumping chamber returns to the intake duct and is not pumped to the common rail through the feed line.

Patent application IT2009BO00197 describes a high pressure pump that is equipped with a collecting chamber, which is arranged under the pumping chamber, with a middle portion of the piston passing through it, and which is connected to the intake duct through a connection duct that discharges close to the inlet valve. An annular seal is provided beneath the collecting chamber, this seal being arranged around a lower portion of the piston and having the function of preventing fuel leakage along the side wall of the piston. In particular, the collecting chamber is delimited laterally and at the top by a lower surface of the main body and is delimited at the bottom by an annular cap that is laterally welded to the main body; the annular cap has a central, cylindrically-shaped seat housing the annular seal. The seat is delimited laterally and at the bottom by the corresponding walls of the annular cap and is delimited at the top by a annular element, which also defines the piston's lower limit; in particular, a shoulder of the piston rests on the annular element, preventing further descent of the piston.

It has been observed that in the high pressure pump described in patent application IT2009BO00197, the seal placed around the piston and beneath the collecting chamber has a short life, i.e. it is subject to high wear with consequent loss of its sealing capability after a short period of operation.

Patent application WO2008061581A1 describes a fuel pump for a direct injection system comprising: a pumping chamber, a piston which is slidingly mounted inside the pumping chamber in order to cyclically vary the volume of the pumping chamber, an intake duct connected to the pumping chamber and regulated by an inlet valve, a delivery duct connected to the pumping chamber and regulated by a one-way valve that only allows outgoing fuel flow from the pumping chamber, and an annular seal, which is placed in a seat arranged below the pumping chamber around a lower portion of the piston and has the function of preventing fuel leakage along the side wall of the piston.

DESCRIPTION OF THE INVENTION

The object of the present invention is to produce a fuel pump for a direct injection system, this fuel pump being devoid of the above-described drawbacks and, at the same time, being easy and inexpensive to make.

The invention overcome the drawbacks in the related art in a fuel pump for a direct injection System. The fuel pump comprises at least one pumping chamber, a piston slidingly mounted inside the pumping chamber to cyclically vary a volume of the pumping chamber, an intake duct connected to the pumping chamber and regulated by an inlet valve, a delivery duct connected to the pumping chamber and regulated by one-way valve allowing only outgoing-fuel flow the pumping chamber, a seat arranged below the pumping chamber around a lower portion of the piston, an annular seal housed in the seat and preventing fuel leakage along a side wall of the piston, and an annular element that delimits, on an upper side thereof, the seat housing the seal such that an axial dimension of the seat is not greater than an axial dimension of the seal to prevent the seal from axially "shaking" inside the seat as a consequence of cyclic axial movement of the piston.

BRIEF DESCRIPTION OF DRAWINGS

The present invention shall now be described with reference to the attached drawings, which illustrate some non-limitative examples of embodiment, where.

PREFERRED EMBODIMENTS OF THE INVENTION

Figure 1:
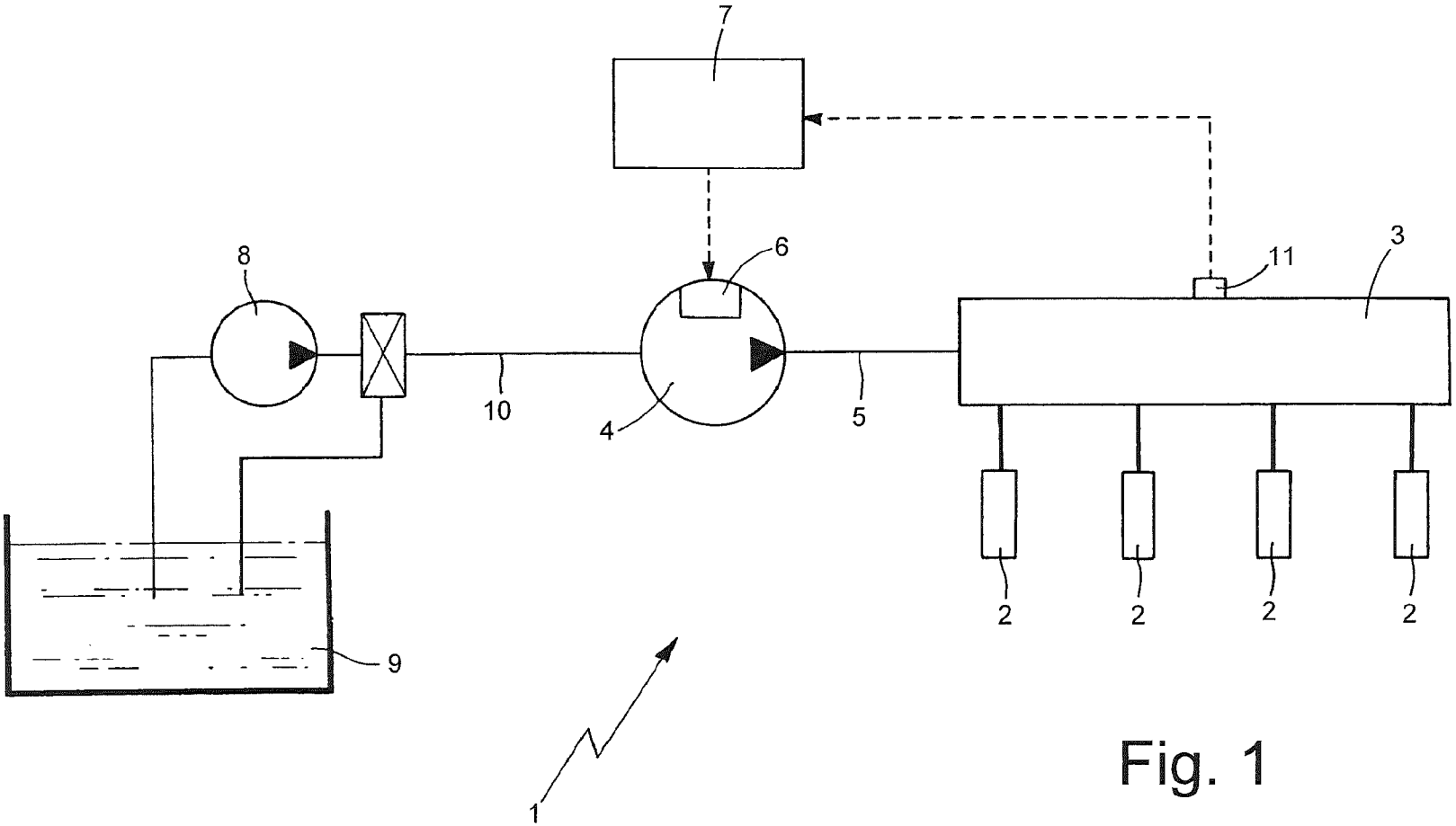
FIG. 1 is a schematic view, with some details removed for clarity, of a direct fuel injection system of the common rail type.

In FIG. 1, reference numeral 1 indicates, in its entirety, a direct fuel injection system of the common rail type for an internal combustion engine.

The direct injection system 1 comprises a plurality of injectors 2, a common rail 3 that feeds fuel under pressure to the injectors 2 and a high pressure pump 4 that feeds fuel to the common rail 3 via a feed line 5, and is equipped with a flow regulating device 6, a control unit 7 that keeps the fuel pressure inside the common rail 3 equal to a desired value that generally varies with time as a function of the engine's operating conditions and a low pressure pump 8 that feeds fuel from a tank 9 to the high pressure pump 4 via a feed line 10.

The control unit 7 is coupled to the flow regulating device 6 to control the flow of the high pressure pump 4 so as to feed the common rail 3, moment by moment, with the quantity of fuel necessary to achieve the desired pressure level within the common rail 3; in particular, the control unit 7 adjusts the flow of the high pressure pump 4 by means of feedback control using the value of the fuel pressure inside the common rail 3, a pressure value detected in real time by a pressure sensor 11, as the feedback variable.

Figure 2:
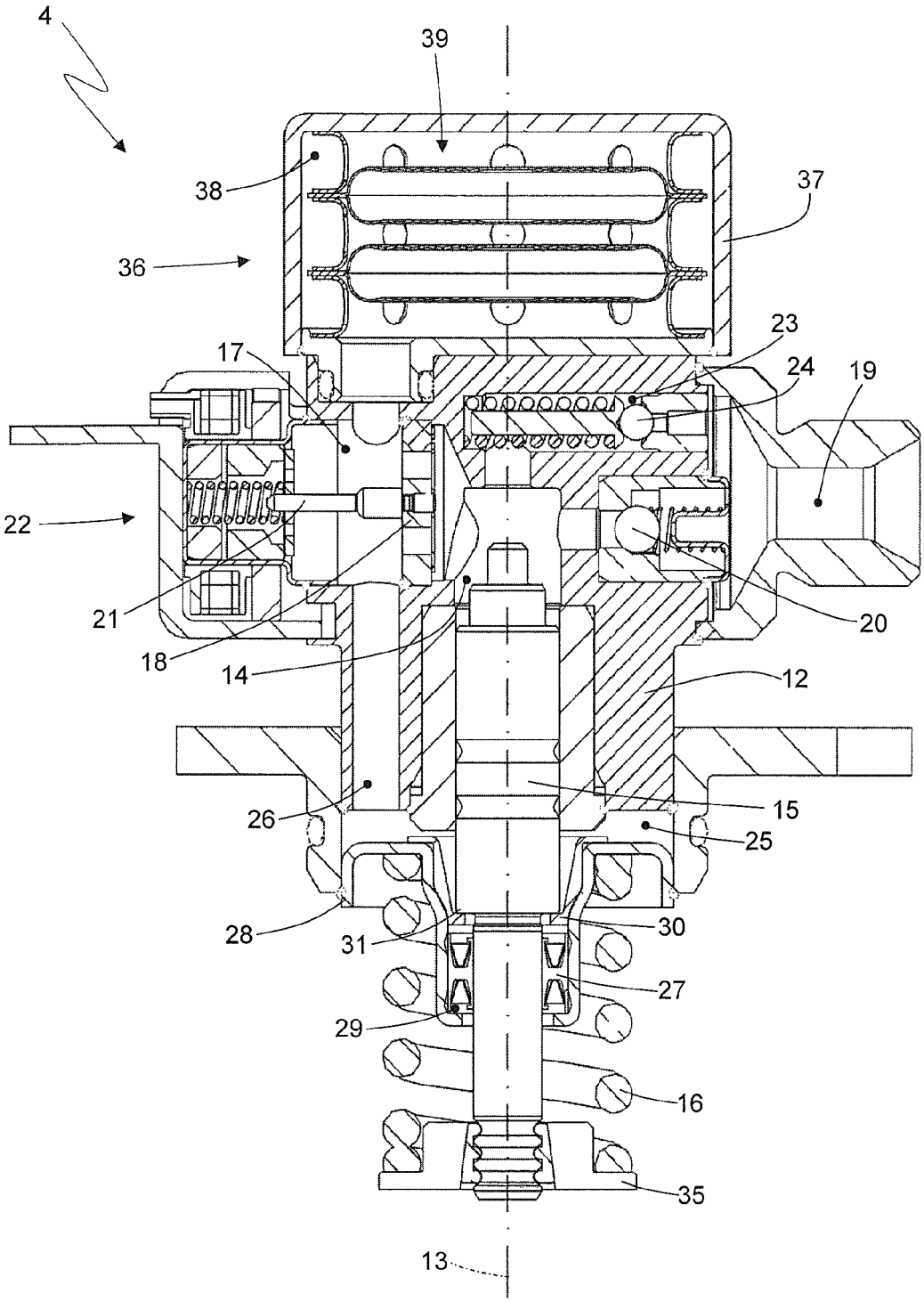
FIG. 2 is a schematic sectional view, with some details removed for clarity, of a high-pressure fuel pump of the direct injection system in FIG. 1.

According to that shown in FIG. 2, the high pressure pump 4 comprises a main body 12 that has a longitudinal axis 13 and internally defines a cylindrically-shaped pumping chamber 14. A piston 15 is slidingly mounted inside the pumping chamber 14 such that, by moving with an alternating motion along the longitudinal axis 13, it causes a cyclic variation in the volume of the pumping chamber 14. A lower portion of the piston 15 is coupled, on the one hand, to a spring 16 that tends to push the piston 15 towards a position of maximum volume for the pumping chamber 14 and, on the other, is coupled to a cam (not shown) that is driven in rotation by a drive shaft of the engine to cyclically move the piston 15 upwards, compressing the spring 16.

An intake duct 17, which is connected to the low pressure pump 8 via feed line 10 and is controlled by an inlet valve 18 arranged in correspondence to the pumping chamber 14, runs from a side wall of the pumping chamber 14. The inlet valve 18 is normally pressure controlled and, without external action, the inlet valve 18 is closed when the fuel pressure in the pumping chamber 14 is higher than the fuel pressure in the intake duct 17 and is open when the fuel pressure in the pumping chamber 14 is lower than the fuel pressure in the intake duct 17.

A delivery duct 19, which is connected to the common rail 3 via the feed line 5 and is controlled by a one-way valve 20 that is arranged in correspondence to the pumping chamber 14 and only allows outgoing fuel flow from the pumping chamber 14, runs from a side wall of the pumping chamber 14 and on the opposite side from the intake duct 17. The delivery valve 20 is pressure controlled and is open when the fuel pressure in the pumping chamber 14 is higher than the fuel pressure in the delivery duct 19 and is closed when the fuel pressure in the pumping chamber 14 is lower than the fuel pressure in the delivery duct 19.

The flow regulating device 6 is coupled to the inlet valve 18 to allow the control unit 7 to keep the inlet valve 18 open during a pumping stage of the piston 15 and therefore allow an outgoing fuel flow from the pumping chamber 14 through the intake duct 17. The flow regulating device 6 comprises a control rod 21, which is coupled to the inlet valve 18 and is movable between an inactive position, where it allows the inlet valve 18 to close, and an operating position, where it does not allow the inlet valve 18 to close. The flow regulating device 6 also comprises an electromagnetic actuator 22, which is coupled to the control rod 21 to move the control rod 21 between the operating position and the inactive position.

A discharge duct 23, which places the pumping chamber 14 in communication with the delivery duct 19 and is controlled by a one-way pressure relief valve 24 that only allows incoming fuel flow to the pumping chamber 14, runs from an upper side of the pumping chamber 14. The function of the pressure relief valve 24 is to allow fuel relief in cases where the fuel pressure in the common rail 3 exceeds a maximum value set in the design stage (typically, in the case of control errors made by the control unit 7); in other words, the pressure relief valve 24 is set to automatically open when the pressure jump at its heads is higher than a threshold value set in the design stage and therefore to prevent the fuel pressure in the common rail 3 from exceeding the maximum value set in the design stage.

A collecting chamber 25 is obtained inside the main body 12, positioned under the pumping chamber 14 and through which a middle portion of the piston 15 passes that is shaped such that, as a consequence of its alternating movement, the volume of the collecting chamber 25 varies cyclically. In particular, the middle portion of the piston 15 that is inside the collecting chamber 25 is shaped like the upper portion of the piston 15 that is inside the pumping chamber 14, so that when the piston 15 moves, the volume variation occurring in the collecting chamber 25 due to the movement of piston 15 is contrary to the volume variation occurring in the pumping chamber 14 due to the movement of piston 15. In ideal conditions, the volume variation occurring in the collecting chamber 25 due to the movement of piston 15 is equal to the volume variation occurring in the pumping chamber 14 due to the movement of piston 15, so as to achieve perfect compensation between the two volume variations; however, due to geometrical and constructional constraints, these ideal conditions cannot always be achieved and therefore it is possible that the volume variation occurring in the collecting chamber 25 due to the movement of piston 15 is less than the volume variation occurring in the pumping chamber 14 due to the movement of piston 15.

The collecting chamber 25 is connected to the intake duct 17 through a connection duct 26 that discharges in correspondence to the inlet valve 18. Furthermore, an annular seal 27 is provided beneath the collecting chamber 25 that is positioned around a lower portion of the piston 15 and has the function of preventing fuel leakage along the side wall of the piston 15. According to a preferred embodiment, the collecting chamber 25 is delimited laterally and at the top by a lower surface of the main body 12 and is delimited at the bottom by an annular cap 28 that is laterally welded to the main body 12. The annular cap 28 has a central, cylindrically-shaped seat 29 housing the annular seal 27. The seat 29 is delimited laterally and at the bottom by the corresponding walls of the annular cap 28 and is delimited at the top by an annular element 30 that also defines a lower limit of travel of the piston 15; in particular, a shoulder 31 of the piston 15 rests on the annular element 30, preventing further descent of the piston 15. It is important to note that the lower limit of travel of the piston 15 constituted by the annular element 30 is only used during the transportation of the high pressure pump 4 to avoid "dismantling" the piston 15; when the high pressure pump 4 is mounted on an engine, the cam (not shown) that is coupled to the external end of the piston 15 always keeps the shoulder 31 of the piston 15 raised above the annular element 30 (in use, possible impact of the shoulder 31 of the piston 15 against the annular element 30 could result in severe damage).

Figure 7:
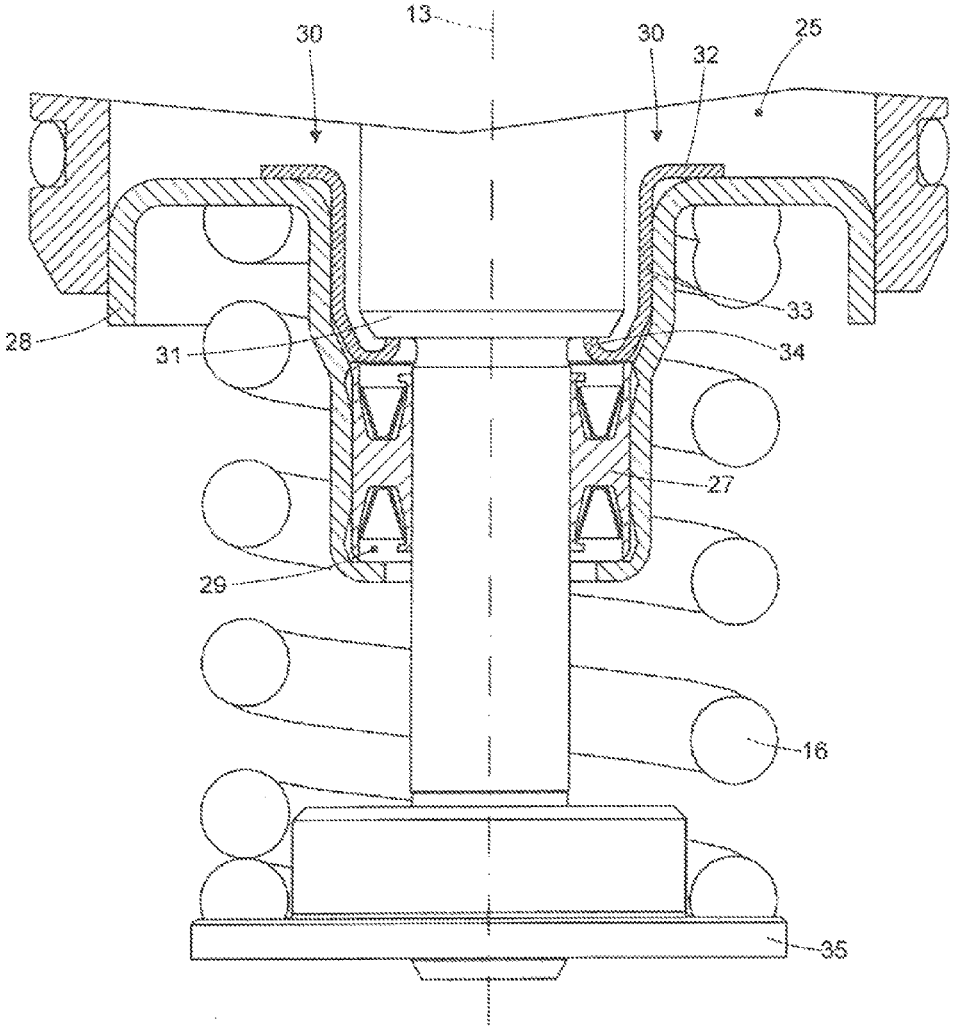
Figure 8:
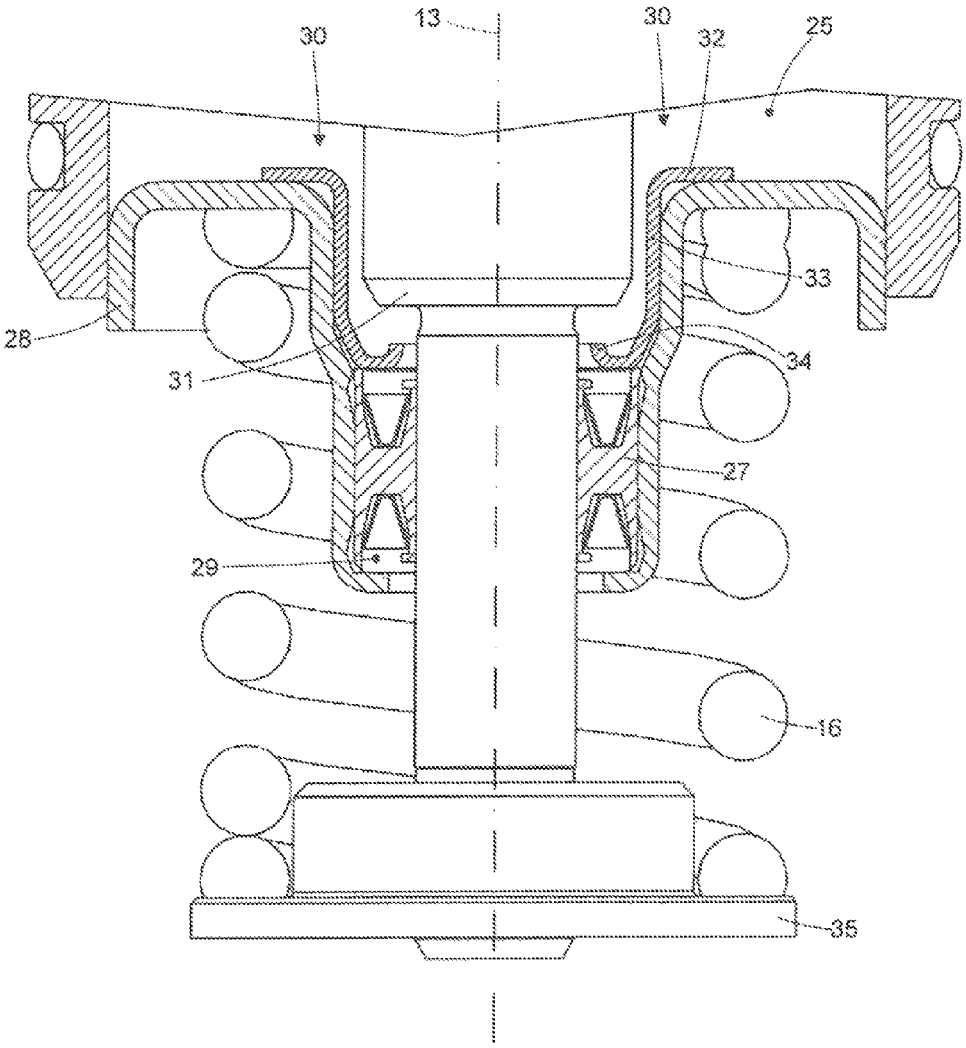

According to the embodiment shown in FIGS. 7 and 8, in addition to having the above-described function of constituting a lower limit of travel for the piston 15, the annular element 30 also has the function of axially restraining the seal 27 in order to avoid possible axial movement of the seal 27 as a consequence of the cyclic axial movement of the piston 15. In other words, the axial dimension of the seat 29 housing the seal 27 is substantially equal (at most, slightly smaller as the seal 27 is axially compressible) to the axial dimension of the seal 27 in order to prevent the seal 27 from axially "shaking" inside the seat 29 as a consequence of the cyclic axial movement of the piston 15, (when the seal 27 axially "shakes"

inside the seat 29, the seal 27 is subjected to cyclical stresses that are potentially destructive in a relatively short period of time). Axially, the seat 29 is delimited at the bottom by a surface of the annular cap 28 and at the top by the annular element 30; thus, the position of the annular element 30 is defined in such a way that the axial dimension of the seat 29 is substantially equal to (or rather not larger than) the axial dimension of the seal 27.

According to the embodiment shown in FIGS. 7 and 8, the annular element 30 has a flat upper edge 32 that rests against an upper side of the annular cap 28, a lateral edge 33 that rests against a side wall of the annular cap 28, and a lower edge 34 that protrudes perpendicularly from the side wall of the annular cap 28 and, on one side, constitutes the lower limit of travel of the piston 15 and, on the other side, forms the upper boundary of the seat 29 housing the seal 27. Preferably, the lower edge 34 has a U-shaped cross section so as to provide a certain elastic deformability (i.e. it can axially deform in an elastic manner), which can be necessary both to compensate possible constructional tolerances and to absorb impact of the shoulder 31 of the piston 15 with less stress. To increase the elastic deformability of the lower edge 34, the lower edge 34 is separated from the side wall of the annular cap 28, i.e. there is a certain gap between the lower edge 34 and the side wall of the annular cap 28. Preferably, the annular element 30 is fixed to the annular cap 28 by welding.

In particular, in FIG. 7, the piston 15 is in its lower limit position where the shoulder 31 is in contact with the annular element 30, while in FIG. 8, the piston 15 is set apart from its lower limit position and therefore the shoulder 31 is at a certain distance from the annular element 30.

As shown in FIG. 2, the spring 23 is compressed between a bottom side of annular cap 28 and an upper side of an annular expansion 35 integral with the bottom end of the piston 15; in this way, the spring 23 is arranged outside the main body 12 and can therefore be visually inspected, whilst also being completely isolated from the fuel.

In use, a first function of the collecting chamber 25 is to collect the fuel that inevitably leaks from the pumping chamber 14 along the side wall of the piston 15 during the pumping stage. This leaked fuel arrives in the collecting chamber 25 and from here is rerouted through the connection duct 26 to the pumping chamber 14. The presence of the annular seal 27 placed beneath the collecting chamber 25 prevents further fuel leakage along the side wall of the piston 15 outside of the collecting chamber 25. It is important to note that the fuel in the collecting chamber 25 is at low pressure and therefore the annular seal 27 is not subjected to high stress.

In use, a further function of the collecting chamber 25 is to contribute to the compensation of pulsations in the fuel flow: when the piston 15 rises, reducing the volume of the pumping chamber 14, the fuel expelled from the pumping chamber 14 through the inlet valve 18 that is held open by the flow regulating device 6 can flow to the collecting chamber 25 as the rise of the piston 15 increases the volume of the collecting chamber 25 (in ideal conditions, by an amount equal to the corresponding reduction of volume of the pumping chamber 14). When the piston 15 rises, reducing the volume of the pumping chamber 14 and the inlet valve 18 is closed, the increase in volume of the collecting chamber 25 causes fuel to be sucked inside the collecting chamber 25 from the intake duct 17. When the piston 15 descends, the volume of the pumping chamber 14 increases and the volume of the collecting chamber 25 drops (by the same amount in ideal conditions); in this situation, the fuel that is expelled from the collecting chamber 25 due to the drop in volume of the collecting chamber 25, is sucked in by the pumping chamber 14 as a consequence of the increase in volume of the pumping chamber 14.

In other words, a cyclic exchange of fuel takes place between the collecting chamber 25 (which fills when the piston 15 rises during the pumping stage and empties when the piston 15 descends during the intake stage) and the pumping chamber 14 (which empties when the piston 15 rises during the pumping stage and fills when the piston 15 descends during the intake stage). In ideal conditions, this exchange of fuel between the collecting chamber 25 and the pumping chamber 14 is optimized when the movement of the piston 15 causes a volume variation in the collecting chamber 25 equal and opposite to the volume variation in the pumping chamber 14; as previously stated, these ideal conditions cannot always be achieved because of geometrical and constructional constraints and therefore it is possible that the volume variation that occurs in the collecting chamber 25 due to the movement of piston 15 is less than the volume variation occurring in the pumping chamber 14 due to the movement of piston 15.

Thanks to the above-described cyclic exchange of fuel between the collecting chamber 25 and the pumping chamber 14, it is possible to achieve a very high reduction in pulsations in the fuel inside the feed line 10; some theoretical simulations have estimated that the reduction in pulsations in the fuel inside the feed line 10 could exceed 50% (i.e. the amplitude of the pulsations is more than halved with respect to a similar high pressure pump without the above-described cyclic exchange of fuel).

The intake duct 17, which partially extends inside the main body 12, connects the feed line 10 to the pumping chamber 14 and is controlled by the inlet valve 18 (arranged in correspondence to the pumping chamber 14). A damper device 36 (compensator), which is positioned along the intake duct 17 (therefore upstream of the inlet valve 18) and fixed to the main body 12 of the high pressure pump 4, has the function of reducing the entity of pulsations in the fuel flow in the low pressure branch (i.e. along the feed line 10) and therefore the entity of oscillations in fuel pressure. Pulsations in the fuel flow can produce noise in the audible range that could be fastidious for the occupants of a vehicle that uses the fuel pump; in addition, fuel pressure oscillations can damage the low pressure pump 8.

The damper device 36 comprises a cylindrically-shaped box 37 inside which a damping chamber 38 is defined that houses two elastically deformable (or rather elastically compressible) damper bodies 39. The function of the damper bodies 39 is to dampen the fluctuations (pulsations) in the fuel flow along the feed line 10. The supply of fuel inside the pumping chamber 14 takes place in a extremely discontinuous manner, i.e. there are moments when fuel enters the pumping chamber 14 (during the intake stage with the inlet valve 18 open), moments when fuel does not enter and does not leave the pumping chamber 14 (during the pumping stage with the inlet valve 18 closed), and moments when fuel leaves the pumping chamber 14 (during the pumping stage with the inlet valve 18 open due to the action of the flow regulating device 6). These discontinuities in the supply of fuel inside the pumping chamber 14 are partially dampened by the volume variation of the damper bodies 39 and thus the flow of fuel through the feed line 10 can be more constant, i.e. less pulsating (or rather, the pulsations remain, but have reduced amplitude).

Figure 3:
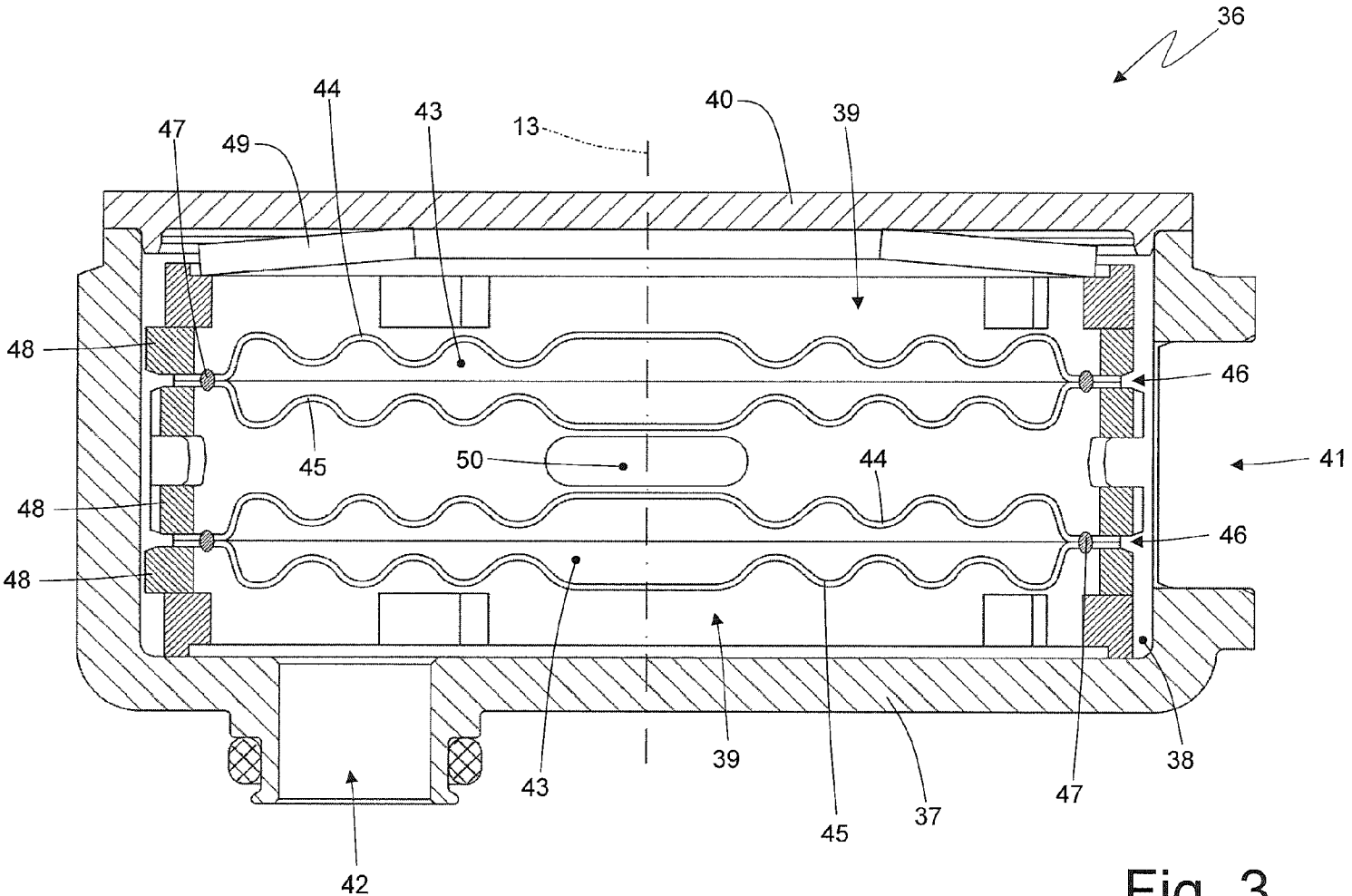
FIG. 3 is a view in an enlarged scale of a different embodiment developed according to the present invention of a damper device of the high-pressure fuel pump in FIG. 2.

According to the embodiment shown in FIG. 3, the box 37 of the damper device 36 comprises an upper lid 40 that closes and seals the damping chamber 38; in addition, the box 37 has a lateral inlet opening 41 connected to the feed line 10 and a lower outlet opening 42 that discharges into the intake duct 17.

Each damper body 39 has a closed internal chamber 43 filled with as under pressure and formed by two cup-shaped sheets of metal 44 and 45, welded together in correspondence to an annular edge 46 by means of a continuous annular weld 47 (i.e. the annular weld 47 extends for 360°, forming a closed circumference in correspondence to the annular edge 46).

The damper bodies 39 are supported inside the damping chamber 38 by annular support elements 48 that grip between each other the outer edges 46 of the damper bodies 39 external to the annular weld 47. In other words, the annular edge 47 of each damper body 39 is gripped above and below by two support elements 48 arranged externally to the annular weld 47. In particular, three support elements 48 are present: two outer or lateral support elements 48 that each hold just one damper body 39 and an inner or central support element 48 that holds both damper bodies 39 and is arranged between the two damper bodies 39.

The set of three support elements 48 is pressed in a pile inside the box 37 by the pressing action of the lid 40 that is transmitted by a disk spring 49 inserted between the lid 40 and the set of three support elements 48; the function of the disk spring 49 inserted between the lid 40 and the set of three support elements 48 is to compensate for constructional tolerances and keep the three support elements 48 pressed in a pile with a predetermined force. According to another embodiment (not shown), the disk spring 49 is not present and its function is performed by support elements 48 that have a certain level of elastic compressibility in the axial direction; in other words, the support elements 48 are axially elastic so as to be able to deform elastically and in an axial direction when compressed by the lid 40.

According to a preferred embodiment, each support element 48 has a series of through holes 50 made in the cylindrical side wall to allow the fuel to flow through the support element 48.

Figure 4:
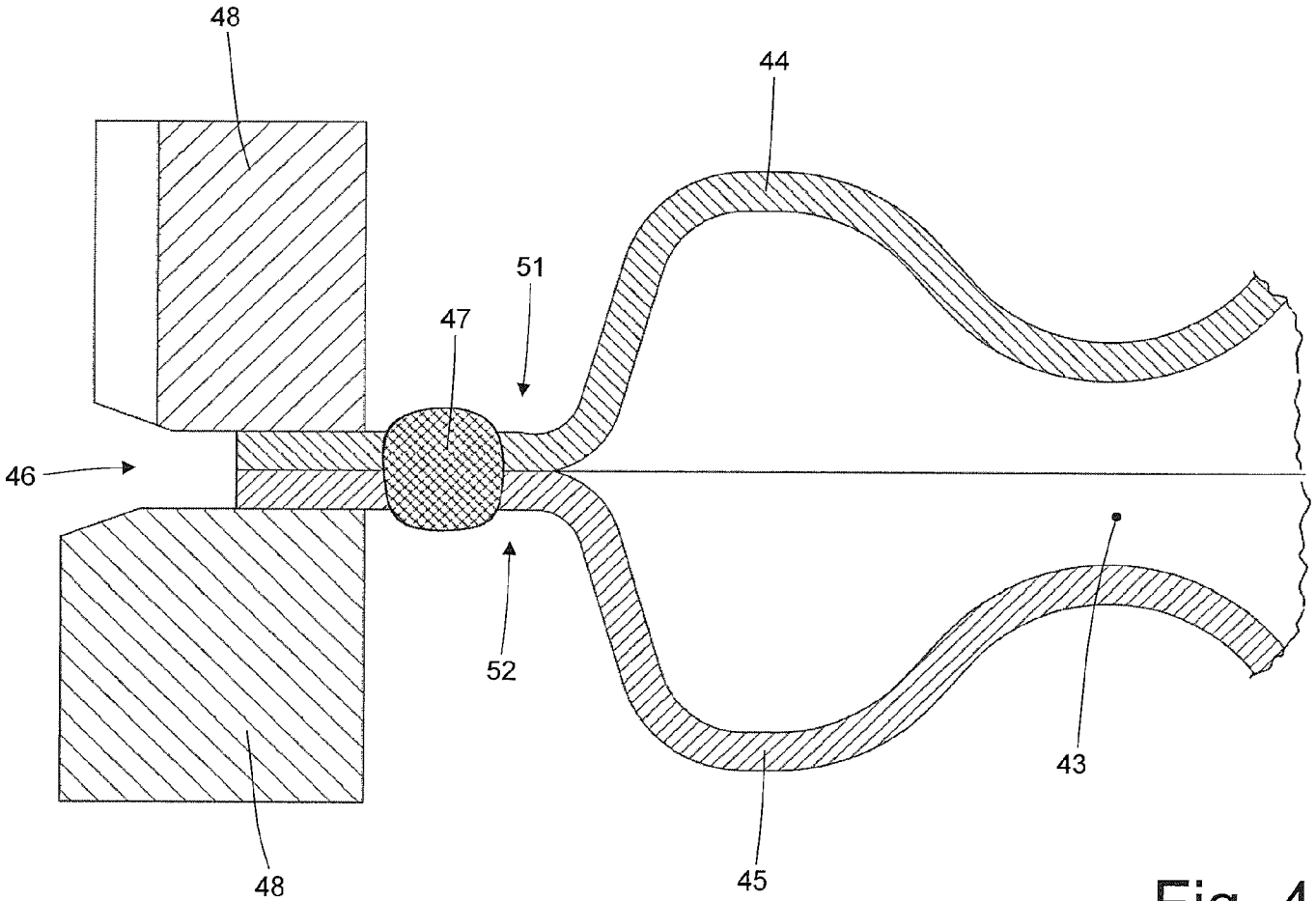
FIG. 4 is a view in an enlarged scale of a detail of the damper device in FIG. 3.

As shown in FIG. 4, the sheets 44 and 45 of each damper body 39 have respective annular edges 51 and 52 that are laid one on top of the other and joined by the annular weld 47 to form the annular edge 46 of the damper body 39. It is important to note that in each damper body 39, the annular weld 47 is made in an intermediate zone of the annular edges 51 and 52 of the sheets 44 and 45 so as to be at a certain distance from the outer ends of the annular edges 51 and 52. In other words, the annular weld 47 is located in an intermediate position between the outer ends of the annular edges 51 and 52 of the sheets 44 and 45 and the closed chamber 43 and, depending on constructional variants, can be located a little closer to the outer ends of the annular edges 51 and 52 or a little closer to the closed chamber 43.

Figure 5:
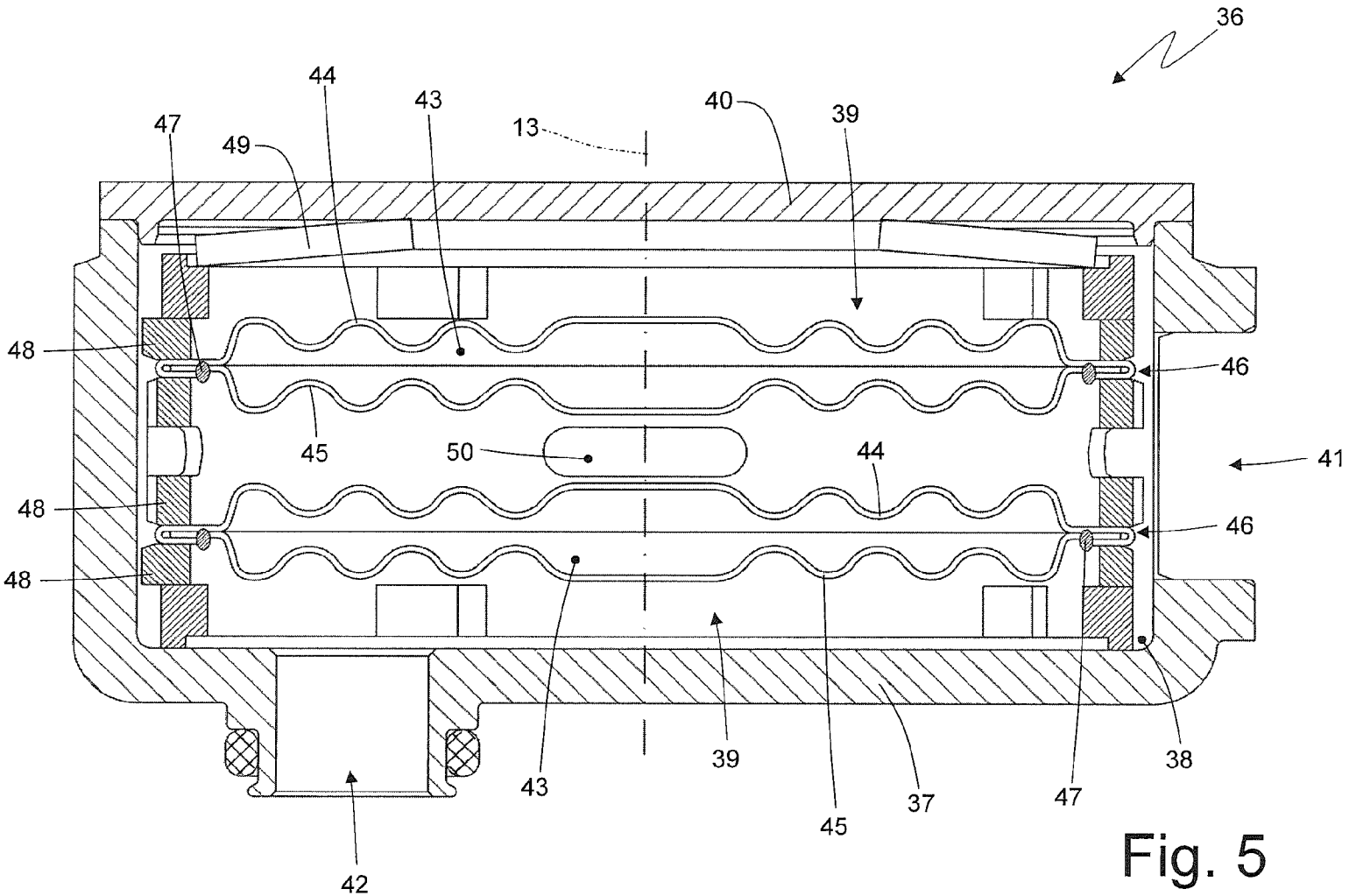
FIG. 5 is a view in an enlarged scale of a variant of the damper device in FIG. 3.
Figure 6:
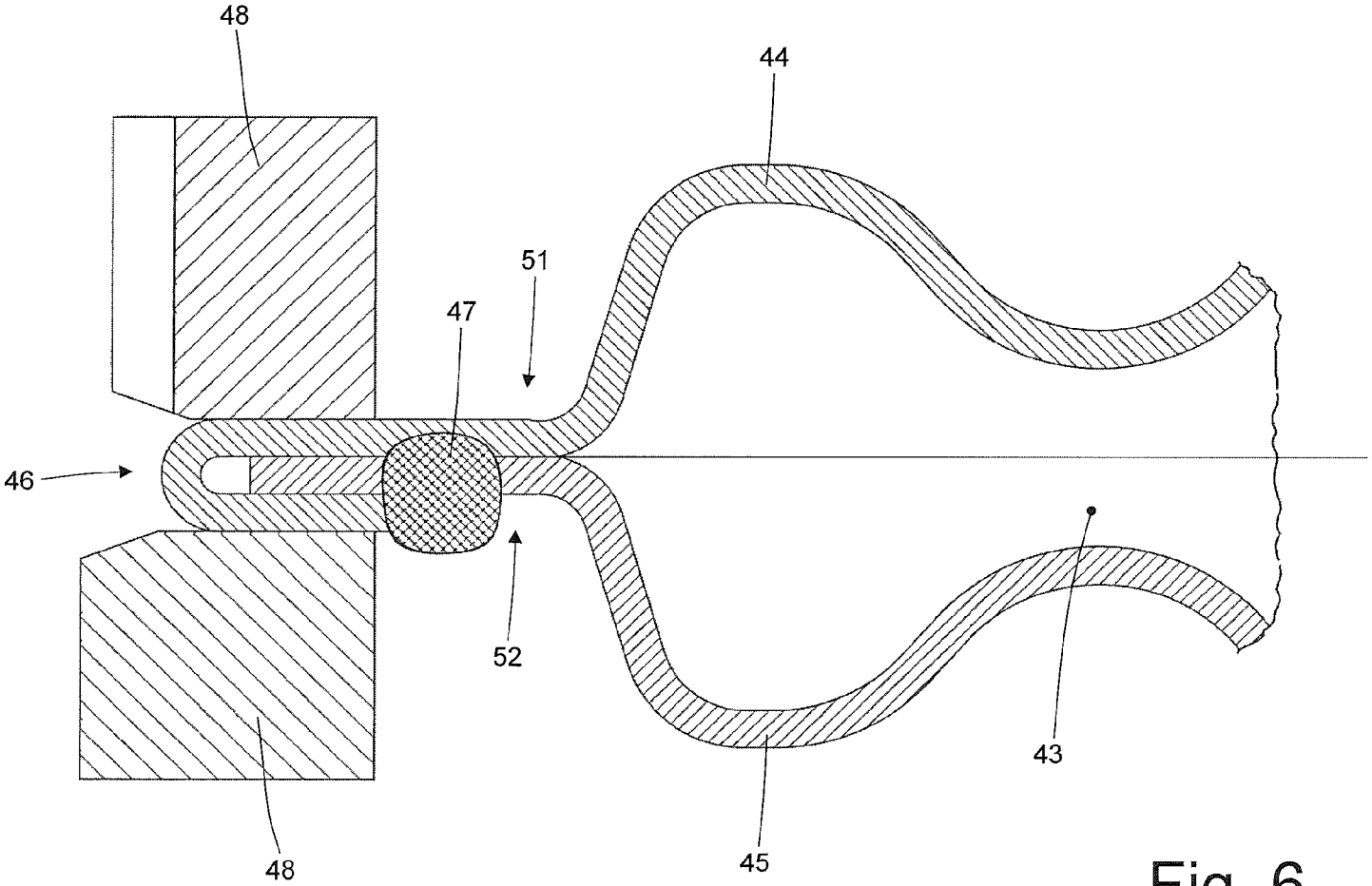
FIG. 6 is a view in an enlarged scale of a detail of the damper device in FIG. 5, and FIGS. 7 and 8 are two views in an enlarged scale and in two different configurations of a different embodiment of an external portion of a piston of the high-pressure fuel pump in FIG. 2.

In the embodiment shown in FIGS. 3 and 4, the annular edges 51 and 52 of the two sheets 44 and 45 have the same shape and size and therefore define a specular structure in correspondence to the annular edge 46 of the damper body 39, in which an inner surface of edge 51 is in contact with an inner surface of edge 52. In the embodiment shown in FIGS. 5 and 6, the annular edges 51 and 52 of the two sheets 44 and 45 have different shapes and sizes: the annular edge 51 of sheet 44 is wider than the annular edge 52 of sheet 45 and is folded in a "U" to enclose (surround) both sides of the annular edge 52 of sheet 45; in other words, the annular edge 52 of sheet 45 is flat, while the annular edge 51 of sheet 44 is U-shaped to enclose both sides of the annular edge 52 of sheet 45. In this embodiment, the annular weld 47 can be double to unite the annular edge 51 of sheet 44 to both sides of the annular edge 52 of sheet 45 (as clearly shown in FIG. 6), or can be single to unite the annular edge 51 of sheet 44 to just one side of the annular edge 52 of sheet 45 (variant not shown).

The above-described damper device 36 has the advantage of guaranteeing the long-term tightness of the damper bodies 39, which are not subject to progressive pressure loss of the gas contained in the closed chambers 53 defined inside the damper bodies 39. This result is achieved thanks to the fact that the annular weld 47 on each damper body 39 is not made in correspondence to the outer ends of the annular edges 51 and 52 of the sheets 44 and 45, but is made in an intermediate zone of the annular edges 51 and 52 of the sheets 44 and 45 (i.e. at a certain distance from the outer ends of the annular edges 51 and 52); in fact, thanks to this positioning of the annular weld 47, the annular weld 47 itself has greater mechanical resistance and less probability of having traversing cracks.

The invention claimed is:

1. A fuel pump for a direct injection system comprising:

at least one pumping chamber;

a piston slidingly mounted inside the pumping chamber to cyclically vary a volume of the pumping chamber;

an intake duct connected to the pumping chamber and regulated by an inlet valve;

a delivery duct connected to the pumping chamber and regulated by a one-way valve allowing only outgoing-fuel flow from the pumping chamber;

a seat arranged below the pumping chamber around a lower portion of the piston;

an annular seal housed in the seat and preventing fuel leakage along a side wall of the piston; and an annular element delimiting, on an upper side thereof, the seat housing the seal such that an axial dimension of the seat is not greater than an axial dimension of the seal to prevent the seal from axially "shaking" inside the seat as a consequence of cyclic axial movement of the piston, wherein the annular element defines a lower limit of travel of the piston and a shoulder of the piston rests on the annular element, preventing further descent of the piston, the annular element has a lower edge that, on one side, forms the lower limit of travel of the piston and, on another side, forms an upper boundary of the seat housing the seal, and the lower edge of the annular element has a U-shaped cross-section so as to provide a certain elastic deformability.

2. The fuel pump according to claim 1, wherein the axial dimension of the seat. housing the seal is slightly smaller than the axial dimension of the seal such that the seal is slightly axially compressed in the seat.

3. The fuel pump according to claim 1, wherein the lower edge is inserted inside an annular cap that supports the lower edge and the lower edge is separated from a side wall of the annular cap.

4. The fuel pump according to claim 1, wherein the fuel pump comprises further annular cap that is welded to a lower portion of a main body of the fuel pump and the seat housing the seal is delimited laterally and at a bottom by corresponding walls of the annular cap and at a top by the annular element.

5. The fuel pump according to claim 4, wherein the annular element defines a substantially flat upper edge that rests against an upper side of the annular cap, a lateral edge that rests against a side wall of the annular cap, and a lower edge that protrudes substantially perpendicularly from the side wall of the annular cap and defines a substantially U-shaped cross-section to provide a certain elastic deformability.

6. The fuel pump according to claim 1, wherein the fuel pump comprises further a collecting chamber, which is positioned under the pumping chamber and over the seal and through which a middle portion of the piston passes.

7. The fuel pump according to claim 6, wherein the fuel pump comprises further a connection duct that connects the collecting chamber to the intake duct and discharges in correspondence to the inlet valve.

8. The fuel pump according to claim 7, wherein the middle portion of the piston that is inside the collecting chamber is shaped such that, as a consequence of alternating movement thereof, a volume of the collecting chamber varies cyclically.

9. The fuel pump according to claim 8, wherein the middle portion of the piston that is inside the collecting, chamber is shaped like an upper portion of the piston that is inside the pumping chamber so that when the piston moves, variation of the volume occurring in the collecting chamber due to the movement of the piston is contrary and equal to variation of the volume occurring in the pumping chamber due to the movement of piston.

10. A fuel pump for a direct injection system comprising:

at least one pumping chamber;

a piston slidingly mounted inside the pumping chamber to cyclically vary a volume of the pumping chamber;

an intake duct connected to the pumping chamber and regulated by an inlet valve;

a delivery duct connected to the pumping chamber and regulated by a one-way valve allowing only outgoing-fuel flow from the pumping chamber;

a seat arranged below the pumping chamber around a lower portion of the piston;

an annular seal housed in the seat and preventing fuel leakage along a side wall of the piston;

an annular element delimiting, on an upper side thereof, the seat housing the seal such that an axial dimension of the seat is not greater than an axial dimension of the seal to prevent the seal from axially "shaking" inside the seat as a consequence of cyclic axial movement of the piston; and an annular cap that is welded to a lower portion of a main body of the filet pump and the seat housing the seal is delimited laterally and at a bottom by corresponding walls of the annular cap and at a top by the annular element, wherein the annular element has a flat upper edge that rests against an upper side of the annular cap, a lateral edge that rests against a side wall of the annular cap, and a lower edge that protrudes perpendicularly from the side wall of the annular cap and has a U-shaped cross-section so as to provide a certain elastic deformability.

11. The fuel pump according to claim 10, wherein the axial dimension of the seat housing the seal is slightly smaller than the axial dimension of the seal such that the seal is slightly axially compressed in the seat.

12. The fuel pump according to claim 10, wherein the annular element defines a lower limit of travel of the piston and a shoulder of the piston rests on the annular element, preventing further descent of the piston.

13. The fuel pump according to claim 12, wherein the annular element has a lower edge that, on one side, forms the lower limit of travel of the piston and, on another side, forms an upper boundary of the seat housing the seal.

14. The fuel pump according to claim 13, wherein the lower edge has a substantially U-shaped cross-section to provide a certain elastic deformability.

15. The fuel pump according to claim 14, wherein the lower edge is inserted inside an annular cap that supports the lower edge and the lower edge is separated from a side wall of the annular cap.

16. The fuel pump according to claim 10, wherein the fuel pump comprises further a collecting chamber, which is positioned under the pumping chamber and over the seal and through which a middle portion of the piston passes.

17. The fuel pump according to claim 16, wherein the fuel pump comprises further a connection duct that connects the collecting chamber to the intake duct and discharges in correspondence to the inlet valve.

18. The fuel pump according to claim 17, wherein the middle portion of the piston that is inside the collecting chamber is shaped such that, as a consequence of alternating movement thereof, a volume of the collecting chamber varies cyclically.

19. The fuel pump according to claim 18, wherein the middle portion of the piston that is inside the collecting chamber is shaped like an upper portion of the piston that is inside the pumping chamber so that when the piston moves, variation of the volume occurring in the collecting chamber due to the movement of the piston is contrary and equal to variation of the volume occurring in the pumping chamber due to the movement of piston.

* * * * *

UNITED STATES PATENT AND TRADEMARK OFFICE

CERTIFICATE OF CORRECTION

PATENT NO. : 8,556,602 B2
APPLICATION NO. : 12/938819
DATED : October 15, 2013
INVENTOR(S) : Luca Mancini et al.

It is certified that error appears in the above-identified patent and that said Letters Patent is hereby corrected as shown below:

In the Claims:

Column 8, line 56 insert --an-- between “further” and “annular”.

Column 9, line 41 delete “filet” and insert therefor --fuel--.

Signed and Sealed this
Seventeenth Day of December, 2013

Margaret A. Focarino

Margaret A. Focarino
*Commissioner for Patents of the United States Patent and Trademark Office*